US006304738B1

(12) United States Patent
Kobayashi et al.

(10) Patent No.: US 6,304,738 B1
(45) Date of Patent: Oct. 16, 2001

(54) IMAGE FORMING APPARATUS WHEREIN TONER IN A DEVELOPING DEVICE TONER AND TONER ON AN IMAGE BEARING MEMBER SATISFY A PRESCRIBED WEIGHT AVERAGE DIAMETER RELATIONSHIP

(75) Inventors: Yoshiaki Kobayashi, Numazu; Masaru Hibino, Minami Ashigara; Masanori Shida, Shizuoka-ken; Ichiro Ozawa, Funabashi, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/503,194

(22) Filed: Feb. 14, 2000

(30) Foreign Application Priority Data

Feb. 17, 1999 (JP) ..... 11-038948
Feb. 1, 2000 (JP) ..... 12-023797

(51) Int. Cl.[7] ..... G03G 15/30

(52) U.S. Cl. ..... 399/149; 399/270

(58) Field of Search ..... 399/149, 148, 399/150, 130, 223, 252, 253, 258, 259, 53, 55, 270; 430/111, 105, 106.6, 109

(56) References Cited

U.S. PATENT DOCUMENTS 5,774,771 * 6/1998 Kukimoto et al. ..... 399/223
5,999,762 * 12/1999 Shoji ..... 399/55
6,002,900 * 12/1999 Ishiyama ..... 399/149

* cited by examiner

*Primary Examiner*—Arthur T. Grimley
*Assistant Examiner*—Hoan Tran
(74) *Attorney, Agent, or Firm*—Fitzpatrick, Cella, Harper & Scinto

(57) ABSTRACT

An image forming apparatus uses a toner wherein when a weight average diameter of the initial toner in a developing device is set to D1, and a weight average diameter of a toner forming an initial toner image on an image bearing member is D2, such that D1≧D2 is satisfied.

15 Claims, 5 Drawing Sheets

IMAGE FORMING APPARATUS WHEREIN TONER IN A DEVELOPING DEVICE TONER AND TONER ON AN IMAGE BEARING MEMBER SATISFY A PRESCRIBED WEIGHT AVERAGE DIAMETER RELATIONSHIP

BACKGROUND OF THE INVENTION

1. Field of the Invention

The present invention relates to electrophotographic system image forming apparatuses such as a copying machine and a printer in which an electrostatic latent image formed on an image bearing member is developed by toner to obtain an image.

2. Related Background Art

An image forming process by an image forming apparatus will be described with reference to FIG. 4.

First, by setting an original G with a surface to be copied facing downward onto an original stand 10, and pressing a copy button, copying is started. When a unit 9 integrally formed of an original irradiation lamp, short focus lens array and CCD sensor irradiates and scans the original, and the lighting scan light reflected by the original surface is formed into an image by the short focus lens array, and is incident upon the CCD sensor.

The CCD sensor is constituted of a light receiving section, transfer section and output section. A light signal is converted to an electric signal in the CCD light receiving section, and successively transferred to the output section in the transfer section in synchronization with a clock pulse, and the charge signal is converted to a voltage signal, and subjected to amplification and low impedance treatment in the output section to emit an output. The analog signal obtained in this manner is subjected to a known image processing, converted to a digital signal and transmitted to an image forming section.

In the image forming section, the above-described image signal is received, and an electrostatic latent image is formed as follows. A photosensitive drum 1 is rotatively driven centering on a central spindle at a predetermined peripheral speed, and uniformly charged to provide a positive or negative polarity by a charger 3 in the process of the rotation. The light of a solid laser element 102 (FIG. 5) turned on/off in response to the image signal and emitted to the uniformly charged surface is scanned by a rotary polygonal mirror 104 (FIG. 5) rotating at a high rate, and the electrostatic latent image is successively formed on the surface of the photosensitive drum 1.

FIG. 5 schematically shows the constitution of a laser scan section 100 for scanning the laser beam in the above-described device. When the laser beam is scanned by the laser scan section 100, the solid laser element 102 is flickered at a predetermined timing by a light emitting signal generating device 101 based on the inputted image signal. Subsequently, the laser beam radiated from the solid laser element 102 is converted to a substantially parallel light flux by a collimator lens system 103, further scanned in the direction of arrow C by the rotary polygonal mirror 104 rotating in the direction of arrow B, and formed into a spot-like image on a scanned surface 106 of a photosensitive drum or the like by the group of fθ lenses 105*a*, 105*b*, 105*c*. By the scanning of the laser beam, an exposure distribution is formed on the scanned surface 106 for one image scanning. Furthermore, when the scanned surface 106 is scrolled by a predetermined amount vertically to the scanning direction for every scanning, the exposure distribution is obtained on the scanned surface 106 in response to the image signal.

A developing process will next be described. Generally, developing methods are roughly classified into four types: a method comprising coating a sleeve with nonmagnetic toner with a blade or the like, or coating the sleeve with magnetic toner using a magnetic force, carrying the toner, and developing the image on the photosensitive drum in a non-contact state (mono-component non-contact development); a method of developing the image of the toner coated as described above in a contact state (mono-component contact development); a method comprising using a mixture of toner particles and a magnetic carrier as a developer, carrying the developer by the magnetic force, and developing the image on the photosensitive drum in the contact state (two-component contact development); and a method of developing the image of the above-described two-component developer in the non-contact state (two-component non-contact development). In respect of the high image quality and high stability of the image, the two-component contact development method is frequently used.

As shown in FIG. 3, a developing device 4 is provided with a developer container 16, the inside of the developer container 16 is divided into a development chamber (first chamber) R1 and an agitation chamber (second chamber) R2 by a partition wall 17, and replenishing toner (nonmagnetic toner) 18 is contained in a toner storage chamber R3. Additionally, the partition wall 17 is provided with a replenishing port (not shown), and the amount of the replenishing toner 18 corresponding to the amount of the consumed toner drops for replenishment in the agitation chamber R2 via the replenishing port.

On the other hand, a developer 19 is contained in the development chamber R1 and the agitation chamber R2. The developer 19 is a two-component developer containing the nonmagnetic toner and magnetic particles (carrier), and the mixture ratio is set so that about 4 to 10% by weight of the nonmagnetic toner is mixed. Here, the nonmagnetic toner has a volume average particle diameter of about 5 to 15 $\mu$m. Moreover, the magnetic particles contain ferrite particles coated with a resin, or resin particles with magnetic materials dispersed therein, the weight average particle diameter is in a range of 25 to 60 $\mu$m, and a volume resistance is in a range of $10^6$ to $10^{12}$ Ω·cm. Furthermore, the permeability of the magnetic particles is in a range of 2.5 to 5.0.

The developer container 16 has an opening in the vicinity of the photosensitive drum 1, and a development sleeve 11 protrudes to the outside via the opening. The development sleeve 11 is rotatably incorporated in the developer container 16. The development sleeve 11 has an outer diameter of 32 mm, and a peripheral speed of 280 mm/sec, and rotates in a direction shown by an arrow in FIG. 3. The development sleeve 11 is disposed so that an interval from the photosensitive drum 1 is about 500 $\mu$m. The development sleeve 11 is formed of a nonmagnetic material, and a magnet 12 is fixed inside as magnetic field generating means.

The magnet 12 has a development pole S1, a magnetic pole N3 positioned on the downstream, and magnetic poles N2, S2, N1 for carrying the developer 19. The magnet 12 is disposed in the development sleeve 11 so that the development pole S1 is substantially opposite to the photosensitive drum 1. The development pole S1 forms a magnetic field in the vicinity of the development section between the development sleeve 11 and the photosensitive drum 1, and a magnetic brush is formed by the magnetic field.

A blade 15 is disposed above the development sleeve 11 and at a predetermined interval from the development sleeve 11. An interval between the development sleeve 11 and the blade 15 is about 800 μm. The blade 15 is fixed to the developer container 16. The blade 15 is formed of nonmagnetic materials such as aluminum and SUS316, and regulates the layer thickness of the developer 19 on the development sleeve 11. A carrying screw 13 is contained in the development chamber R1. The carrying screw 13 is rotated in a direction shown by an arrow of FIG. 3, and the developer 19 in the development chamber R1 is carried in the longitudinal direction of the development sleeve 11 by rotatively driving the carrying screw 13.

A carrying screw 14 is contained in the agitation chamber R2. The carrying screw 14 carries the toner along the longitudinal direction of the development sleeve 11 by its rotation. The toner freely drops into the agitation chamber R2 from a replenishing port 20 of the storage chamber R3.

The development sleeve 11 bears the developer in the vicinity of the magnetic pole N2, and the developer 19 is carried toward the development section with the rotation of the development sleeve 11. When the developer 19 reaches the vicinity of the development section, the magnetic particles of the developer 19 are connected by the magnetic force of the magnetic pole S1, and raised from the development sleeve 11 to form the magnetic brush of the developer 19.

For a developing system, a reversal developing system is used, and a direct-current voltage and alternating voltage are applied to the development sleeve 11 from a power source (not shown). In this conventional example, the direct-current voltage of −500V, an alternating voltage Vpp=2000V, and a rectangular wave Vf=2000 Hz are applied. Generally, when the alternating is applied, the development efficiency increases, and the image obtains a high grade, but fog is easily generated. Therefore, usually by producing a potential difference between the direct-current voltage applied to the developing device 4 and the surface potential of the photosensitive drum 1, the fog is prevented.

In this example, the fog removing potential is 150V which is a difference between the first uniformly charged potential of −650V and the direct current voltage of −500V applied to the development sleeve 11. On the other hand, a difference of 300V between the exposed and attenuated potential of −200V and the direct-current voltage of −500V applied to the development sleeve 11 corresponds to a contrast potential for attaching the toner to the photosensitive drum from the development sleeve.

The toner image formed in this manner on the photosensitive drum 1 is electrostatically transferred to a transfer material by a transfer charger 7 (see FIG. 1). Thereafter, the transfer material is electrostatically separated by a separating charger 8 (see FIG. 1), conveyed to a fixing device 6, and thermally fixed so that the image is outputted.

On the other hand, after the toner image is transferred, the surface of the photosensitive drum 1 is subjected to removal of adhering contaminants such as a transfer residual toner by a cleaner 5 (see FIG. 5), and repeatedly used for image formation. The above-described constitution is only an example. For example, instead of a corona charger, a fur brush, a magnetic brush, or a charging roller is used as a charger 2, a transfer roller is used as a transfer charger, and various systems are used. However, the image is basically formed in the above-described process.

In recent years, the miniaturization of the image forming apparatus has advanced. However, when only the above-described charging, exposure, developing, transfer, fixing and cleaning processes are miniaturized, the miniaturization of the entire apparatus is limited. Moreover, the above-described transfer residual toner is recovered and discarded by the cleaner 5, but it is preferable also from the respect of environment protection that such waste toner should not be generated. Therefore, the cleaner is removed, and a cleanerless apparatus is proposed to perform the cleaning simultaneous with developing by the developing device.

The cleaning simultaneous with developing is a method of recovering a slight residual toner on the photosensitive drum after the transfer by a fog removing bias during developing on and after the next process. According to this method, since the transfer residual toner is recovered and used in the subsequent processes, the waste toner is eliminated, and maintenance troubles can be reduced. Moreover, a great space advantage is provided, and the apparatus can remarkably be reduced in size. Additionally, to enhance the cleaning efficiency in the simultaneous developing/cleaning system, for example, the use of a substantially spherical toner manufactured by a polymerization process and very superior in mold release properties is very effective.

However, the present inventors have found that the following problems are caused in the process of image formation on several tens of thousand of sheets in the simultaneous developing/cleaning system in which the apparatus can be reduced in size as described above, as compared with the system having the cleaner.

(1) The image density is gradually lowered particularly in a low humidity environment.

(2) The amount of flying toner increases particularly in a high humidity environment.

As a result of studies by the present inventors, it has been found that these phenomena are attributed to the inadequacies of the particle diameter of the toner developed on the photosensitive member, particle diameter of the residual toner on the photosensitive member, triboelectrification amount of these two toners with the magnetic carrier, and the like.

Specifically, for example, for the developing process, when the solid toner image is formed on the photosensitive member under the alternation electric field, and when the weight average diameter of the toner particles forming the toner image is larger than the weight average diameter of the toner particles in the developer container, during repetition of the image formation, the toner particles in the developer container shift toward the small diameter side. As a result, when the image is repeatedly formed, the developing property and image density are deteriorated as compared with the initial stage.

In the apparatus provided with the cleaner, developing bias conditions, and the like may be set so that the toner particle diameter on the photosensitive member becomes equal to the toner particle diameter in the developer container. However, since the simultaneous developing/cleaning system is constituted to recover the residual toner on the photosensitive member into the developer container (generally, since the toner passes through the transfer process, the toner particle diameter becomes smaller than that in the developer container, or an external addition ratio is lowered in many cases), the toner particles in the developer container more easily shift to the small diameter side as compared with those in the system provided with the cleaner.

In this case, when the triboelectrification amount of the residual toner on the photosensitive member with the magnetic carrier in the developer container is higher than that of the toner in the developer container or the replenishing toner container with the magnetic carrier, the electrification amount increases as the image formation advances. Additionally, the ratio of the small particle diameter toner increases as described above. Therefore, the image density is remarkably lowered particularly under the low humid environment. On the other hand, when the triboelectrification amount of the residual toner on the photosensitive member with the magnetic carrier in the developer container is lower than that of the toner in the developer container or the replenishing toner container with the magnetic carrier, the ratio of the toner particles with the small diameter and low triboelectrification amount increases in the developer container, and the toner flying amount increases particularly under the high humid environment.

Specifically, as described above, the studies of the present inventors have revealed that in the simultaneous developing/cleaning system, since the relation between the particle diameter of the toner for developing the electrostatic latent image on the photosensitive member and the particle diameter of the toner remaining on the photosensitive member and recovered into the developer container, and the relation in triboelectrification amount between these toners are not adequately set to maintain the initial state of the toner particle diameter distribution in the developer container, the above-described problems occur.

SUMMARY OF THE INVENTION

An object of the present invention is to provide an image forming apparatus which can form a stable image over a long period.

Another object of the present invention is to provide an image forming apparatus in which the above-described relation of the toner particle diameters is optimized, and the initial state of a toner particle diameter distribution in a developer container is maintained, so that a stable image can be formed.

A further object of the present invention is to provide an image forming apparatus comprising an image bearing member for bearing a latent image, developing means for developing the latent image on the image bearing member to form a toner image by a developer containing a toner and a carrier, and transfer means for transferring the toner image on a transfer material, the toner remaining on the image bearing member being collected into the developing means by the developing means after transfer by the transfer means. When a weight average diameter of the initial toner in the developing means is set to D1, and the weight average diameter of a toner forming an initial toner image on the image bearing member is D2, $D1 \geqq D2$ is satisfied.

Objects other than the above-described objects and characteristics of the present invention will further be clarified upon reading the following detailed description with reference to the drawings.

DETAILED DESCRIPTION OF THE PREFERRED EMBODIMENTS

Figure 2A:
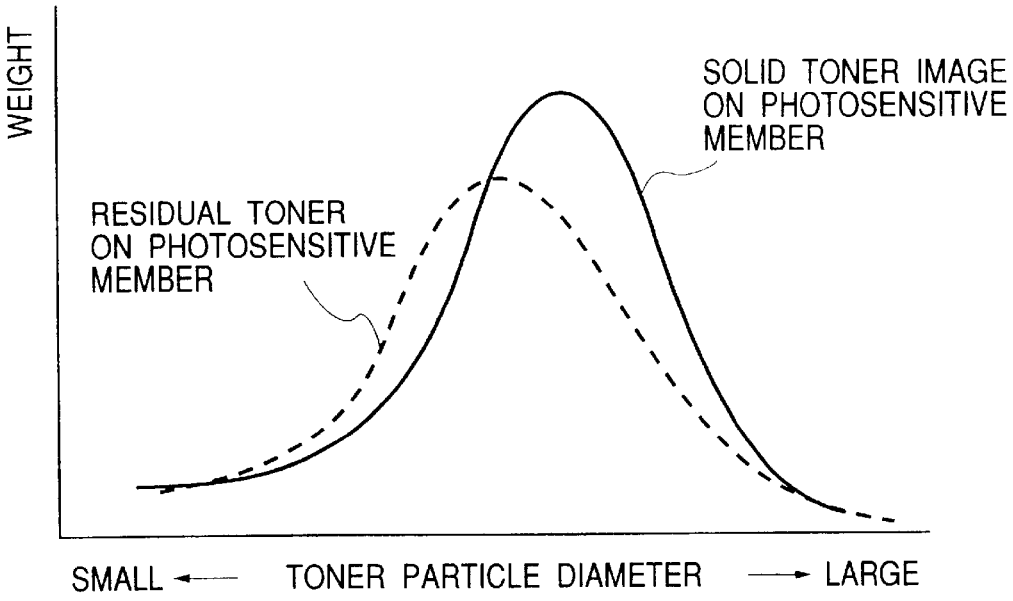
FIGS. 2A and 2B are graphs showing relations between the particle size distribution of a solid toner image on a photosensitive member and the particle size distribution of a residual toner on the photosensitive member.

Generally, the residual toner on the photosensitive member is a toner which cannot be transferred to a transfer material in a transfer process, and the particle size distribution tends to shift toward a smaller particle diameter side than the particle size distribution of the toner particles on the photosensitive member before the transfer (see FIG. 2A, an intermolecular force and reflection force are relative). Therefore, in order to maintain the initial state of the toner particle size distribution in a developer container in a simultaneous developing/cleaning system, the developer has to be provided with developing properties in consideration of the small particle diameter toner residual on the photosensitive member to be recovered to the developer container through cleaning.

Specifically, the particle size distribution of the toner for developing the electrostatic latent image on the photosensitive member needs to be shifted to the small particle diameter side than the particle size distribution of the toner in the developer container. Particularly, the particle diameter D3 of the residual toner on the photosensitive member is preferably set to be substantially equal to the particle diameter D2 of the developing toner on the photosensitive member. Additionally, it is ideal to set the particle diameter D1 of the toner particles in the developer container to be substantially equal. To obtain the above-described relation, a concrete method of obtaining an appropriate toner particle diameter in each stage preferably comprises setting the frequency of a developing bias alternating-current component to be appropriate. The range of the frequency subtly changes with a gap between a development sleeve and the opposite portion of the photosensitive member, peripheral speed ratio of the development sleeve and photosensitive member, particle diameters of the toner and carrier for use, triboelectrification, and the like. In an alternating-current bias applied two-component developing device for general use at present, the frequency is usually set not less than 6 kHz and not more than 12 kHz, preferably not less than 8 kHz and not more than 10 kHz. When the frequency is set to 6 kHz or less, even for the toner with a large particle diameter, the particle size distribution of the toner on the photosensitive member easily shifts to the large particle diameter side by following the frequency. On the other hand, when the frequency is set to 12 kHz or more, the time for forming the electric field to direct the toner toward the photosensitive member is excessively shortened. Even the small particle diameter toner with a higher acceleration than that of the large particle diameter toner cannot easily reach the photosensitive member, and is easily trapped by the carrier present between the sleeve and the photosensitive member. As a result, the effect of shifting the particle size distribution of the toner on the photosensitive member toward the small particle diameter side is supposedly deteriorated.

A reason why more small particle diameter toner adheres to the photosensitive member with a higher frequency will be described hereinafter.

Generally, when the toner flies by the developing electric field E, a force F applied to the toner satisfies F=qE, in which q denotes the charging amount of the toner.

Therefore, when the toner mass is set to m, and the acceleration is a, this motion equation can be represented as F=ma=qE.

Thereby, the acceleration a during the toner flying satisfies a=E·q/m. It is seen that when the developing electric field E is constant, the toners equal to each other in q/m have the same moving property (acceleration a). Here, when the charging amount q and mass m are represented by the charging density σ and toner particle diameter d, q=σS=σ·Ad2, m=Bd3, therefore q/m=(σA/B)·(d2/d3)=C/d (here, A, B, C are constants). This equation indicates that the toner with a smaller particle diameter d has a larger acceleration a.

When the frequency is raised, the time for forming the electric field to direct the toner to the photosensitive member, and the time for forming the electric field to extract the toner back from the photosensitive member are both shortened. Therefore, the toner (small particle diameter toner) having a large acceleration can reach the photosensitive member, but the toner having a small acceleration (large particle diameter toner) cannot reach the photosensitive member. Therefore, the higher the frequency is, the more the small particle diameter toner adheres to the photosensitive member.

On the other hand, in the general simultaneous developing/cleaning system, dependent on the waveform of the developing bias, the residual toner with a small particle diameter is recovered in the developer container as described above. Particularly, in the durable image output in which the image formation is repeatedly performed, the particle diameter D2 of the developing toner on the photosensitive member becomes larger than the particle diameter D1 of the toner particles in the developer container, which deteriorates the image density.

Figure 2B:
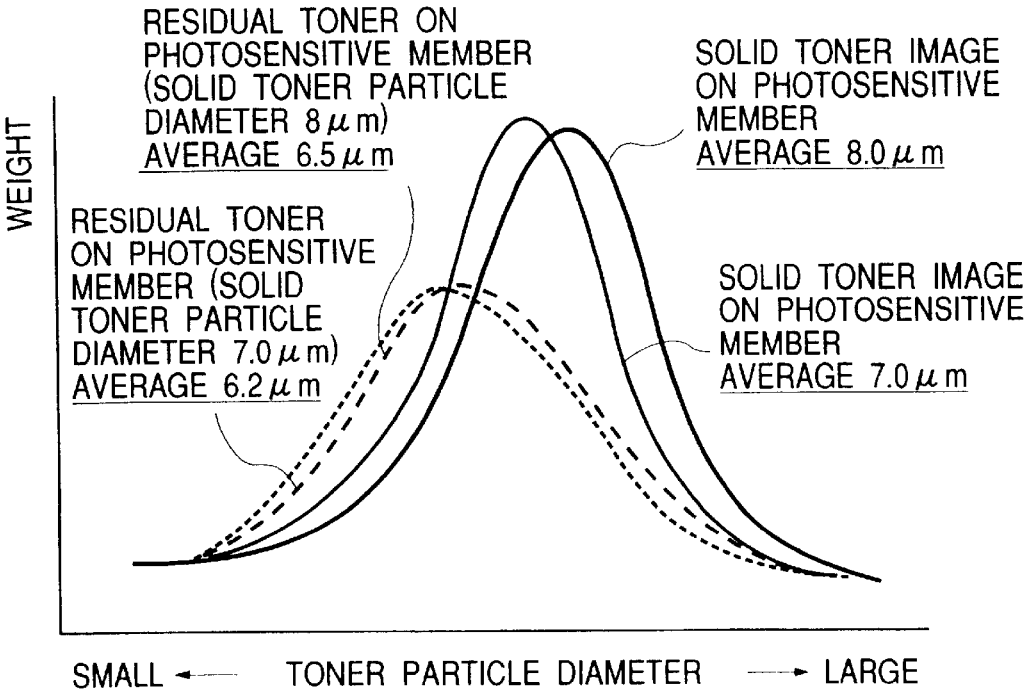
Figure 3:
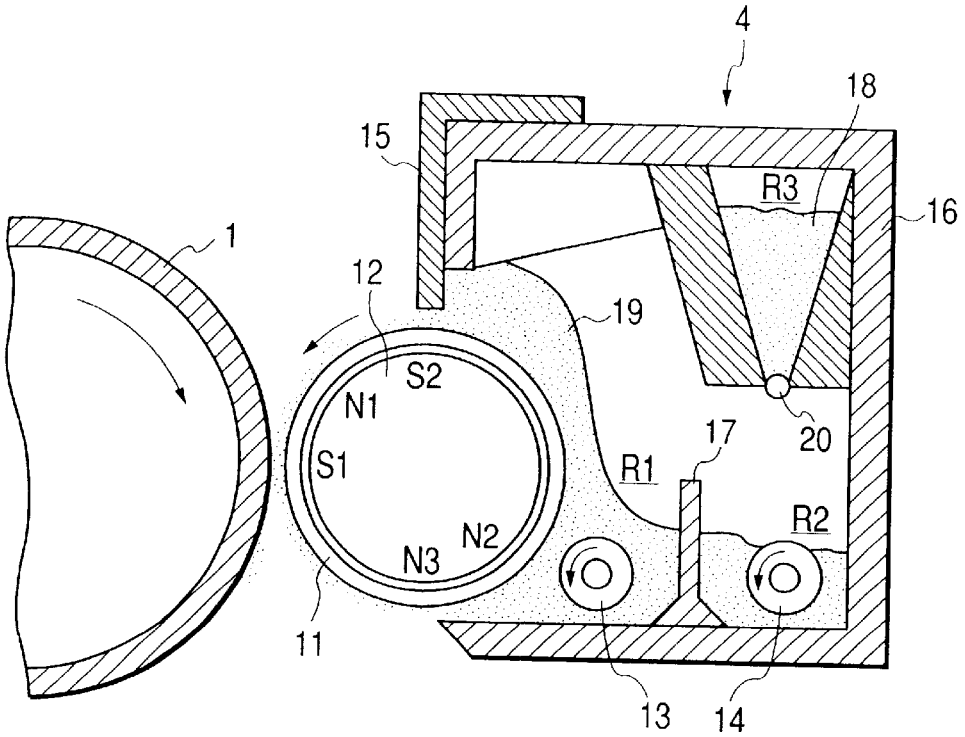
FIG. 3 is a schematic sectional view of a developing device in the image forming apparatus showing the embodiment of the present invention and a related example.
Figure 5:
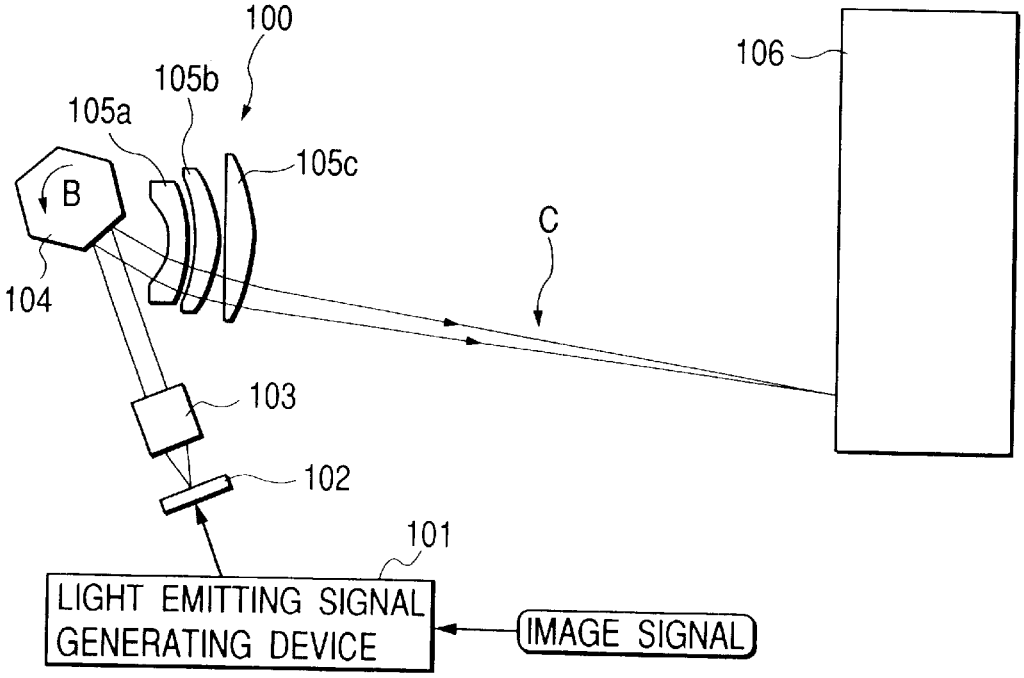
FIG. 5 is a schematic diagram of a laser scan section 100 for scanning laser beams in the image forming apparatus applied to the embodiment of the present invention and the related example.
Figure 4:
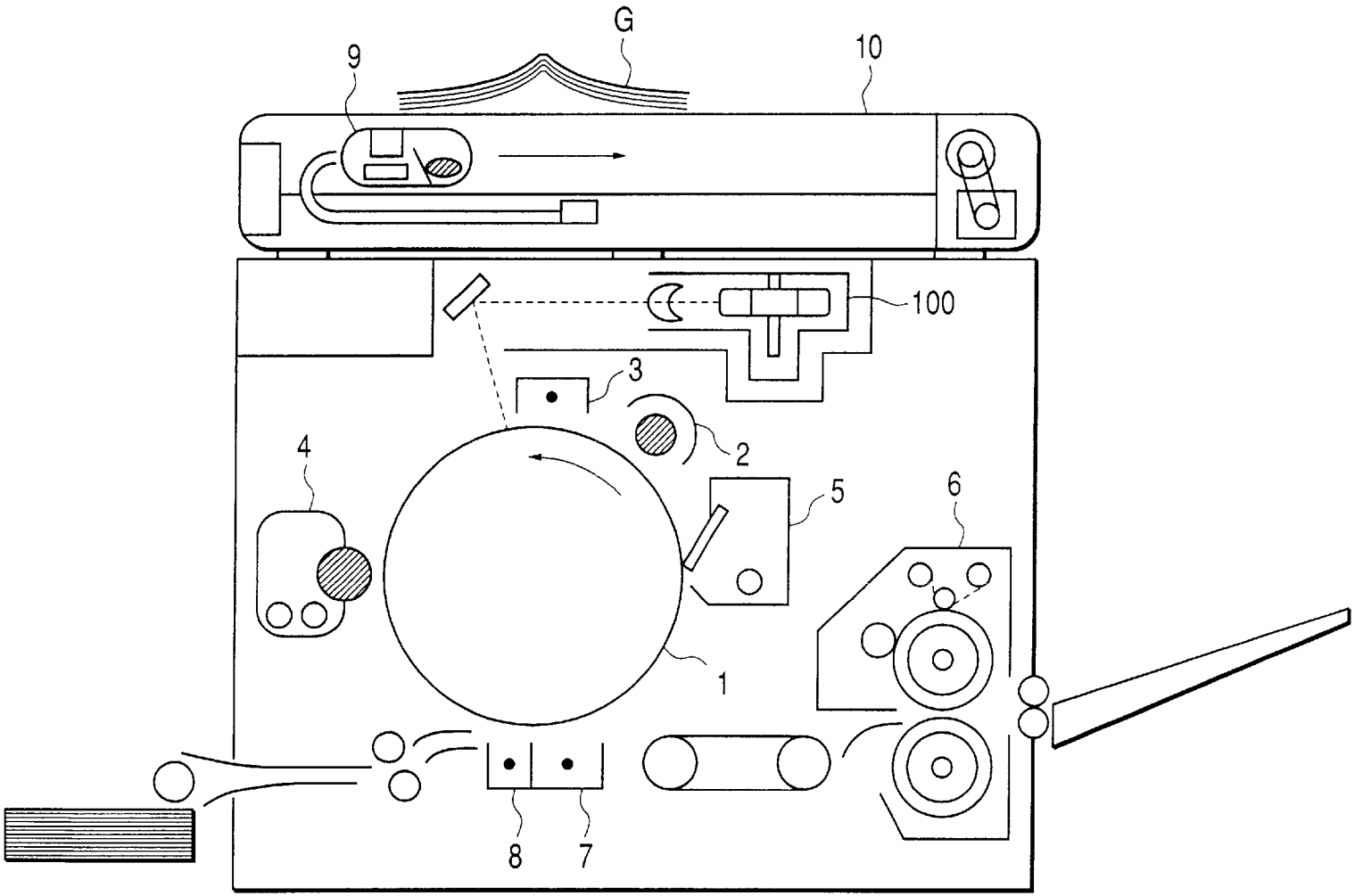
FIG. 4 is a schematic diagram of the image forming apparatus applied to the related example of the present invention.

Additionally, when the particle diameter D2 of the toner to be developed is reduced, it can be contemplated that the diameter becomes smaller than the particle diameter D3 of the residual toner. According to the experiments by the present inventors et al., as shown in FIG. 2B, it has been found that the particle diameter variation ratio of the residual toner is considerably small with respect to the particle diameter variation ratio of the toner developed on the photosensitive member. The reason is supposedly that the particle diameter D3 of the residual toner is substantially determined in the transfer process, and the toner with a diameter equal to or less than a certain value is necessarily residual on the photosensitive member with respect to the intermolecular force and reflection force as long as the transfer bias is unchanged. However, a difference of the particle diameter varied in the experiments is about 1 μm. When the difference exceeds this value, the difference between the particle diameter variation ratio of the toner particle D2 developed on the photosensitive member and the particle diameter variation ratio of the residual toner particle D3 is actually reduced.

The appropriate relation in triboelectrification amount between these particles will next be described. The studies of the present inventors et al. have revealed that a relation of $0.8 \leqq Q1/Q2 \leqq 1.5$ (equation 3) is maintained as the relation in triboelectrification amount between residual toner Q2 and initial toner Q1 in the developer container without remarkably deteriorating the image density or increasing the toner flying. Specifically, when a value of Q1/Q2 is smaller than 0.8, the image density is lowered. On the other hand, when the value of Q1/Q2 is larger than 1.5, the toner flies/scatters, and fog is sometimes generated in the image.

The toner passed through the transfer process and left on the photosensitive member usually has a drop in the ratio of an external additive on the surface. Therefore, the residual toner has a lower fluidity as compared with the initial toner in the developer container or the toner in the toner replenishing container. As a result, this advantageously acts against the flying toner. The triboelectrification amount of the residual toner is slightly advantageous when it is lower than the triboelectrification amount of the initial toner in the developer container. On the other hand, even when the ratio of the external additive is lowered, the increase of the triboelectrification amount of the magnetic carrier is advantageous for the flying of the toner. Therefore, in the image forming method of the present invention, the toner in the two-component developer preferably contains fine particles of colored resin, and an external additive of fine inorganic particles smaller in diameter than the fine particles of colored resin. The toner is preferably constituted so that when the external addition ratio of the external additive decreases, the triboelectrification amount per unit weight of the toner and magnetic carrier increases.

More preferably, in order to reduce the amount of the external additive, for example, the spherical fine particles of colored resin prepared by the polymerization process and superior in fluidity are preferably used as a toner classified product. Such toner can provide an effect that the triboelectrification amount variation caused by the ratio of the external additive, that is, the triboelectrification amount difference between the residual toner on the photosensitive member and the initial toner in the developer container is reduced.

Figure 1:
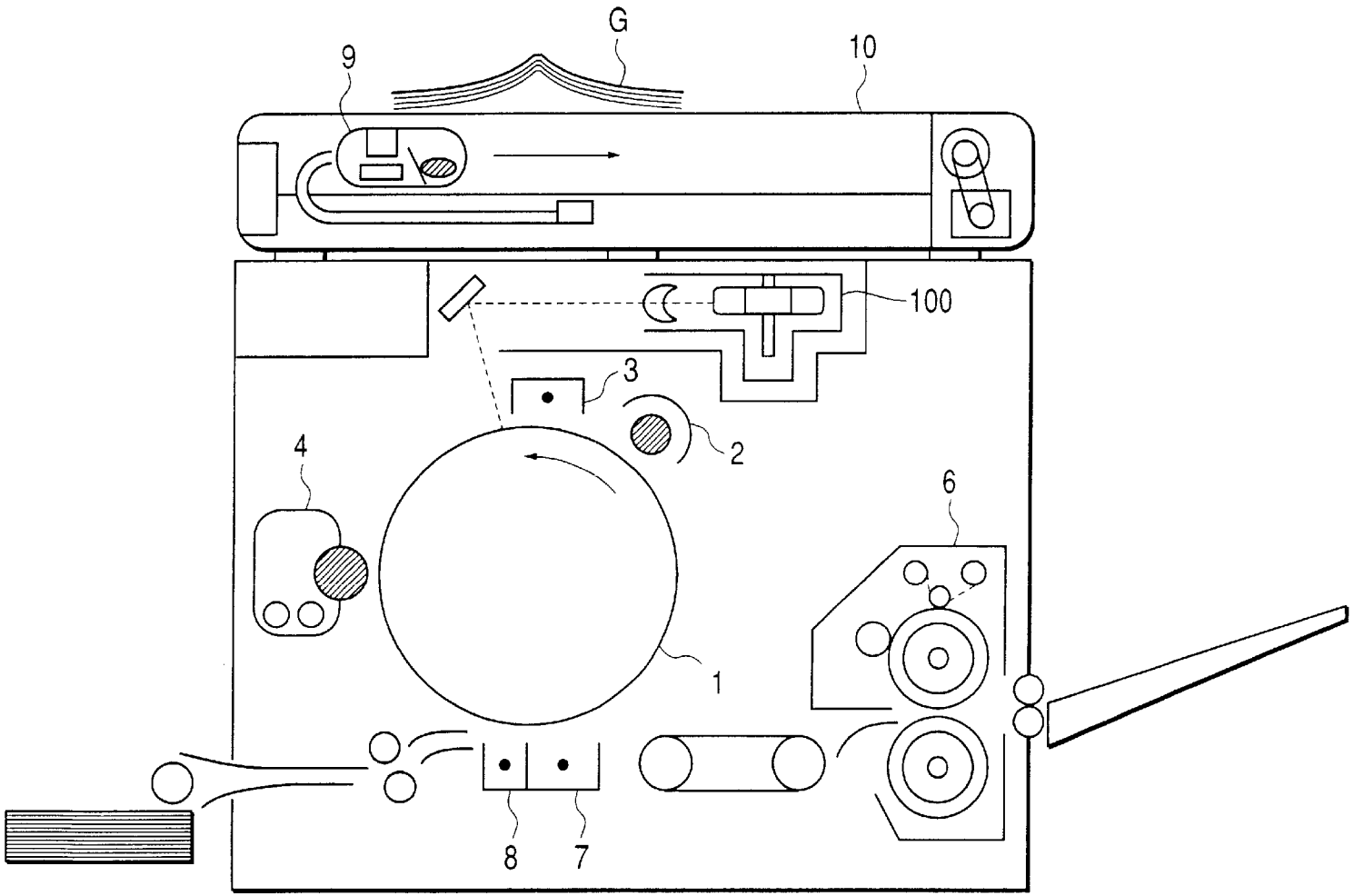
FIG. 1 is a schematic diagram showing one embodiment of an image forming apparatus for use in the present invention.

An image forming method of the present invention using the image forming apparatus shown in FIG. 1 will briefly be described. First, by setting the original G with the surface to be copied facing downward onto the original stand 10, and pressing the copy button, the copying is started. When the unit 9 integrally formed of the original irradiation lamp, short focus lens array and CCD sensor irradiates and scans the original, and the lighting scan light reflected by the original surface is formed into the image by the short focus lens array, and is incident upon the CCD sensor.

The CCD sensor is constituted of the light receiving section, transfer section and output section. The light signal is converted to the electric signal in the CCD light receiving section, and successively transferred to the output section in the transfer section in synchronization with the clock pulse, and the charge signal is converted to the voltage signal, and subjected to the amplification and low impedance treatment in the output section to emit the output. The analog signal obtained in this manner is subjected to the known image processing, converted to the digital signal and transmitted to the image forming section.

In the image forming section, the above-described image signal is received, and the electrostatic latent image is formed as follows. The photosensitive drum 1 is rotatively driven centering on the central spindle at the predetermined peripheral speed, and uniformly charged to provide the positive or negative polarity by the charger 3 in the process of the rotation. The light of the solid laser element 102 turned on/off in response to the image signal and emitted to the uniformly charged surface is scanned by the rotary polygonal mirror 104 rotating at a high rate, and the electrostatic latent image is successively formed on the surface of the photosensitive drum 1.

The electrostatic latent image is developed by the developing device described later to form a toner image on the photosensitive drum. The toner image formed on the photosensitive drum 1 is electrostatically transferred to the transfer material by the transfer charger 7. Thereafter, the transfer material is electrostatically separated by the separating charger 8, conveyed to the fixing device 6, and thermally fixed so that the image is outputted. On the other hand, after the toner image is transferred, the transfer residual toner is left on the surface of the photosensitive drum 1, but this transfer residual toner is collected (recovered) by the developing device during the next rotation.

The above-described constitution is only an example. For example, instead of a corona charger, a charging roller may be used as a charger 3, a transfer roller may be used as the transfer charger 7, and various systems may be used. However, basically as described above, the image is formed in the charging, exposure, developing, transfer and fixing processes. The transfer residual toner is collected by the developing device 4. Additionally, since the constitution of the simultaneous developing/cleaning device of the image forming apparatus for use in the present embodiment is substantially the same as the developing device described in the related example, the detailed description thereof is omitted.

The developer used in the present embodiment is a two-component developer which contains 1% by weight of externally added fine inorganic particles with an average particle diameter of 20 nm, and magnetic particles (carrier) with a saturation magnetization of 205 emu/cm$^2$ ($205\times4\pi\times10^{-4}=8.2\pi\times10^{-2}$ Wb/m$^2$) and an average particle diameter of 50 $\mu$m, with respect to the toner manufactured by a grinding process and having an average particle diameter of 8 $\mu$m. The mixture ratio is set so that about 5% by weight of the nonmagnetic toner is mixed, but this is not limited as described later in detail.

Moreover, for a vibration bias voltage obtained by superposing a direct-current voltage to an alternating-current voltage applied to the development sleeve, the frequency is set to a high frequency not less than 6 kHz and not more than 12 kHz, more preferable not less than 8 kHz and not more than 10 kHz so that the particle diameter of the toner developed on the photosensitive member is set to be smaller than the particle diameter of the initial toner in the developer container. This frequency sometimes causes a slight problem in gradation of the formed image. In this case, the alternating-current voltage may intermittently be applied. Specifically, by applying several pulses only of the direct-current voltage after the alternating-current voltage, a so-called blank pulse bias may be used. However, when only the time for the direct-current voltage is set to be long, the developing toner on the photosensitive member cannot easily be shifted toward the small particle diameter side. Therefore, optimization needs to be performed by considering the particle diameter and triboelectrification amount of the toner particles for use, interval between the development sleeve and the photosensitive member, relative speed of the development sleeve and photosensitive member, and the like. A rectangular wave, sine wave, triangular wave, and the like can be used as the waveform of the vibration bias voltage.

Figure 6:
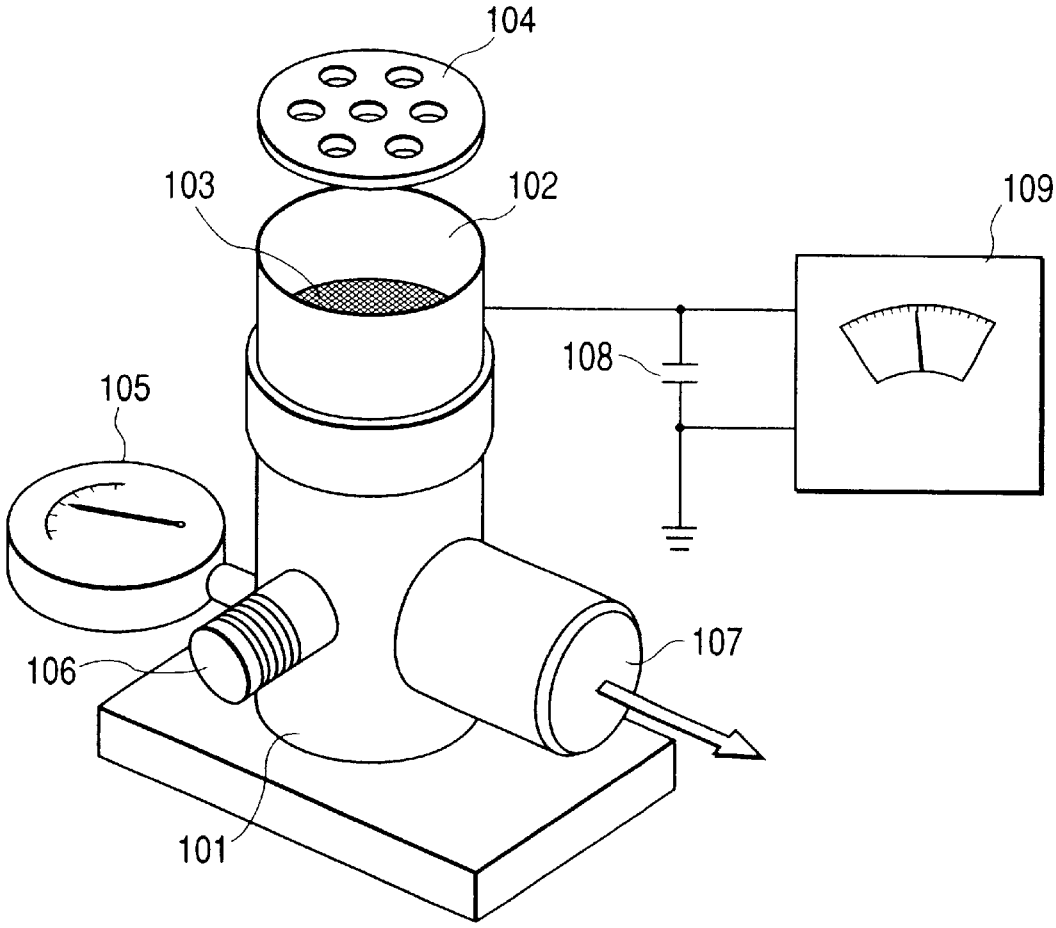
FIG. 6 is a schematic diagram of a device for measuring the triboelectrification amount of a two-component developer.

Here, a method of measuring the triboelectrification amount of the toner (two-component developer) will be described hereinafter with reference to the drawing. FIG. 6 is an explanatory view of a device for measuring the tribo-charging amount of the toner. The method comprises: first placing the two-component developer whose triboelectrification amount is to be measured in a polyethylene bottle with a capacity of 50 to 100 ml ($50\times10^{-6}$ to $100\times10^{-6}$ m$^3$); manually shaking the bottle for about 10 to 40 seconds; placing about 0.5 to 1.5 g of the developer in a metal measurement container 102 of a 500 mesh screen 103; and placing a metal lid 104.

The toner volume average particle diameter in a range of 4 to 15 $\mu$m can preferably be used. Here, the toner volume average particle diameter is measured, for example, by the following measuring method for use.

Coulter counter TA-II type (Coulter Electronics Inc.) is used as the measuring device, an interface (manufactured by Nikkaki K. K.) for outputting a number average distribution, or a volume average distribution and CX-i personal computer (manufactured by Cannon Inc.) are connected, and first-class sodium chloride is used as an electrolytic solution to prepare 1% NaCl aqueous solution. To 100 to 150 ml of the electrolytic solution, 0.1 to 5 ml of surfactant (preferably alkyl benzene sulfonate) is added as a dispersant, and further 0.5 to 50 mg of measurement sample is added.

The electrolytic solution with the sample suspended therein is subjected to a dispersion treatment with an ultrasonic dispersing unit for about one to three minutes, a 100 $\mu$m aperture is used to measure the particle size distribution of 2 to 40 $\mu$m particles with the Coulter counter TA-II type, and a volume distribution is obtained. The volume average particle diameter of the sample is obtained from the above-described volume distribution.

The external additive for use in the present embodiment preferably has a particle diameter of 1/10 or less of the volume average diameter of the toner particles in respect of the durability during toner addition. The particle diameter of the additive means the average particle diameter obtained by observing the surface of the toner particle in an electron microscope.

Examples of the external additive include metal oxides (such as aluminum oxide, titanium oxide, strontium titanate, cerium oxide, magnesium oxide, chromium oxide, tin oxide, and zinc oxide), nitrides (such as silicon nitride), carbides (such as silicon carbide), metal salts (such as calcium sulfate, barium sulfate, and calcium carbonate), aliphatic acid metal salts (such as zinc stearate, and calcium stearate), carbon blacks, silica, and the like.

With respect to 100 parts by weight of toner particles, the external additive is used in a range of 0.01 to 10 parts by weight, preferably 0.05 to 5 parts by weight. The external additive may be used alone or by combining a plurality of additives. The additives are preferably subjected to a hydrophobic treatment. In the preferred embodiment of the present invention, titanium oxide with an average particle diameter of 20 nm is externally added by 1% by weight for use.

A known carrier can be used as a carrier constituting the developer for use in the present embodiment together with the above-described toner. For example, a resin carrier formed by dispersing magnetite as a magnetic material in the resin and dispersing carbon black to realize conduction and adjust resistance, a carrier obtained by oxidizing the surface of a magnetite simplex such as ferrite and applying a reduction treatment to adjust the resistance, a carrier formed by coating the surface of the magnetite simplex such as ferrite with resin to adjust the resistance, and the like may be used. A method of manufacturing the magnetic carrier is not particularly limited.

In the preferred embodiment of the present invention, the magnetic carrier has a voltage average particle diameter of 20 to 100 $\mu$m, preferably 20 to 70 $\mu$m, and a resistance of $10^{12}$ Ωcm or more in an electric field intensity with a specific resistance of $5\times10^4$ V/m. In this case, a method of measuring the specific resistance of the carrier for use comprises: filling a cell with the carrier; placing electrodes 1 and 2 in contact with the filling carrier; applying a voltage between these electrodes; and measuring the flowing current to obtain the specific resistance.

In the measuring method, since the carrier is powder, the filling ratio changes, and the specific resistance accordingly changes, which requires attention. Moreover, as the conditions for measuring the specific resistance of the carrier used in the present invention, the contact area S of the filling carrier and electrodes was set to about 2.3 $cm^2$, thickness d was about 2 mm, the load of the upper electrode 2 was 180 g, and the applied voltage was 100 V. Additionally, the true density of the carrier and the true density of the toner are set to 3.6 $g/cm^3$ and 1.1 $g/cm^3$, respectively.

EMBODIMENTS

Embodiment 1

The image forming apparatus shown in FIG. 1 was used, the image formation was performed on the following conditions, and the image density and toner flying/scattering on the transfer sheet were evaluated.

Conditions

A mixture (with a toner concentration of 8 wt %) of a polymer spherical nonmagnetic toner mainly containing a surface layer polyester resin, and a ferrite carrier with a surface subjected to a silicon coat treatment was used as the two-component developer. The following toner particle diameter, developing bias, and the like were used in each stage.

- Weight average diameter (D1) of initial toner in developer container . . . 8.0 $\mu$m
- Weight average diameter (D2) of solid toner image on photosensitive member . . . 7.0 $\mu$m
- Weight average diameter (D3) of residual toner on photosensitive member . . . 6.6 $\mu$m
- Developing bias:
  - for DC . . . −500 V
  - for AC . . . After repeating one pulse of 2 kVpp, 8 kHz twice, a halt is made for six pulses of AC; rectangular wave
  - light (bright) portion potential . . . −200 V
- Interval between development sleeve and photosensitive member . . . 500 $\mu$m Additionally, the "initial" means a period until 100 image formations are performed (this applies to the following examples and comparative examples).

Triboelectrification Amount

The triboelectrification amount was measured under the environment of 23° C./50% R.H. by the above-described two-component blow-off process. As a result, the triboelectrification amount Q1 of the initial toner and the developing carrier was −22 mC/kg, the triboelectrification amount Q2 of the residual toner on the photosensitive member and the developing carrier was −25 mC/kg, and the ratio of both was Q1/Q2=0.88.

In the image formation under the above-described conditions, when the image forming operation of 50,000 sheets was repeated, the volume average diameter of the toner particles in the developer container slightly shifted to the small particle diameter side, but the image density of 1.5 or more was constantly obtained, and a satisfactory image was obtained with any toner flying/scattering. Additionally, for the image density, the reflective density of the image on the transfer sheet was measured using densitometer 941 type manufactured X-Rite Incorporated.

Embodiment 2

The image forming apparatus shown in FIG. 1 was used, the image formation was performed on the following conditions, and the image density and toner flying/scattering on the transfer sheet were evaluated.

Conditions

A mixture (with a toner concentration of 6 wt %) of a grinding system nonmagnetic toner mainly containing a polyester resin, and a ferrite carrier with a surface subjected to a silicon coat treatment was used as the two-component developer. The following toner particle diameter, developing bias, and the like were used in each stage.

- Weight average diameter (D1) of initial toner in developer container . . . 8.0 $\mu$m
- Weight average diameter (D2) of solid toner image on photosensitive member . . . 7.2 $\mu$m
- Weight average diameter (D3) of residual toner on photosensitive member . . . 6.7 $\mu$m
- Developing bias:
  - for DC . . . −500 V
  - for AC . . . 2000 Vpp, 6000 Hz, rectangular wave
  - bright portion potential . . . −200 V
- Interval between development sleeve and photosensitive member . . . 500 $\mu$m Triboelectrification Amount The triboelectrification amount was measured under the environment of 23° C./50% R.H. by the above-described two-component blow-off process. As a result, the triboelectrification amount Q1 of the initial toner and the developing carrier was −22 mC/kg, the triboelectrification amount Q2 of the residual toner on the photosensitive member and the developing carrier was −27.5 mC/kg, and the ratio of both was Q1/Q2=0.8.

In the image formation under the above-described conditions, when the image forming operation of 50,000 sheets was repeated, the volume average diameter of the toner particles in the developer container slightly shifted to the small particle diameter side, and the triboelectrification amount was slightly high, but the image density of 1.4 to 1.5 was constantly obtained, and a satisfactory image was obtained with any toner flying/scattering.

Embodiment 3

The image forming apparatus shown in FIG. 1 was used, the image formation was performed on the following conditions, and the image density and toner flying/scattering on the transfer sheet were evaluated.

Conditions

A mixture (with a toner concentration of 8 wt %) of the grinding system nonmagnetic toner mainly containing the polyester resin, and the ferrite carrier with the surface subjected to the silicon coat treatment was used as the two-component developer. The following toner particle diameter, developing bias, and the like were used in each stage.

- Weight average diameter (D1) of initial toner in developer container . . . 8.0 $\mu$m
- Weight average diameter (D2) of solid toner image on photosensitive member . . . 7.2 $\mu$m
- Weight average diameter (D3) of residual toner on photosensitive member . . . 7.0 $\mu$m
- Developing bias:

for DC . . . −500 V
for AC . . . 2000 Vpp, 6000 Hz, rectangular wave
bright portion potential . . . −200 V Interval between development sleeve and photosensitive member . . . 500 μm Triboelectrification Amount The triboelectrification amount was measured under the environment of 23° C./50% R.H. by the above-described two-component blow-off process. As a result, the triboelectrification amount Q1 of the initial toner and the developing carrier was −25 mC/kg, the triboelectrification amount Q2 of the residual toner on the photosensitive member and the developing carrier was −22 mC/kg, and the ratio of both was Q1/Q2=1.14.

In the image formation under the above-described conditions, when the image forming operation of 50,000 sheets was repeated, the volume average diameter of the toner particles in the developer container slightly shifted to the small particle diameter side, and the triboelectrification amount was slightly high, but the image density of 1.4 to 1.5 was constantly obtained, and a satisfactory image was obtained with any toner flying/scattering.

Embodiment 4

The image forming apparatus shown in FIG. 1 was used, the image formation was performed on the following conditions, and the image density and toner flying/scattering on the transfer sheet were evaluated.

Conditions

The mixture (with a toner concentration of 8 wt %) of he grinding system nonmagnetic toner mainly containing the polyester resin, and the ferrite carrier with the surface subjected to the silicon coat treatment was used as the two-component developer. The following toner particle diameter, developing bias, and the like were used in each stage.

Weight average diameter (D1) of initial toner in developer container . . . 8.0 μm Weight average diameter (D2) of solid toner image on photosensitive member . . . 7.0 μm Weight average diameter (D3) of residual toner on photosensitive member . . . 6.8 μm Developing bias:
for DC . . . −500 V
for AC . . . 2000 Vpp, 10 kHz, rectangular wave
bright portion potential . . . −200 V Interval between development sleeve and photosensitive member . . . 500 μm Triboelectrification Amount The triboelectrification amount was measured under the environment of 23° C./50% R.H. by the above-described two-component blow-off process. As a result, the triboelectrification amount Q1 of the initial toner and the developing carrier was −25 mC/kg, the triboelectrification amount Q2 of the residual toner on the photosensitive member and the developing carrier was −30 mC/kg, and the ratio of both was Q1/Q2=0.83.

In the image formation under the above-described conditions, when the image forming operation of 50,000 sheets was repeated, the volume average diameter of the toner particles in the developer container slightly shifted to the small particle diameter side, and the triboelectrification amount was slightly high, but the image density of 1.4 to 1.5 was constantly obtained, and a satisfactory image was obtained with any toner flying/scattering.

Embodiment 5

The image forming apparatus shown in FIG. 1 was used, the image formation was performed on the following conditions, and the image density and toner flying/scattering on the transfer sheet were evaluated.

Conditions

The mixture (with a toner concentration of 8 wt %) of the grinding system nonmagnetic toner mainly containing the polyester resin, and the ferrite carrier with the surface subjected to the silicon coat treatment was used as the two-component developer. The following toner particle diameter, developing bias, and the like were used in each stage.

Weight average diameter (D1) of initial toner in developer container . . . 8.0 μm Weight average diameter (D2) of solid toner image on photosensitive member . . . 7.6 μm Weight average diameter (D3) of residual toner on photosensitive member . . . 7.2 μm Developing bias:
for DC . . . −500 V
for AC . . . 2000 Vpp, 12 kHz, rectangular wave bright portion potential . . . −200 V Interval between development sleeve and photosensitive member . . . 500 μm Triboelectrification Amount The triboelectrification amount was measured under the environment of 23° C./50% R.H. by the above-described two-component blow-off process. As a result, the triboelectrification amount Q1 of the initial toner and the developing carrier was −25 mC/kg, the triboelectrification amount Q2 of the residual toner on the photosensitive member and the developing carrier was −28 mC/kg, and the ratio of both was Q1/Q2=0.89.

In the image formation under the above-described conditions, when the image forming operation of 50,000 sheets was repeated, the volume average diameter of the toner particles in the developer container slightly shifted to the small particle diameter side, and the triboelectrification amount was slightly high, but the image density of 1.5 or more was constantly obtained, and a satisfactory image was obtained with any toner flying/scattering.

Comparative Example 1

The image forming apparatus shown in FIG. 1 was used, the image formation was performed on the following conditions, and the image density and toner flying/scattering on the transfer sheet were evaluated.

Conditions

The mixture (with a toner concentration of 4 wt %) of the grinding system nonmagnetic toner mainly containing the polyester resin, and the ferrite carrier with the surface subjected to the silicon coat treatment was used as the two-component developer. The following toner particle diameter, developing bias, and the like were used in each stage.

Weight average diameter (D1) of initial toner in developer container . . . 7.8 μm Weight average diameter (D2) of solid toner image on photosensitive member . . . 8.0 μm Weight average diameter (D3) of residual toner on photosensitive member . . . 6.8 μm Developing bias:
for DC . . . −500 V
for AC . . . 2000 Vpp, 2000 Hz, sine wave
bright portion potential . . . −200 V Interval between development sleeve and photosensitive member . . . 500 μm Triboelectrification Amount The triboelectrification amount was measured under the environment of 23° C./50% R.H. by the above-described two-component blow-off process. As a result, the triboelectrification amount Q1 of the initial toner and the developing carrier was −22 mC/kg, the triboelectrification amount Q2 of the residual toner on the photosensitive member and the developing carrier was −32 mC/kg, and the ratio of both was Q1/Q2=0.69.

In the image formation under the above-described conditions, when the image forming operation of 20,000 sheets was repeated, the volume average diameter of the toner particles in the developer container shifted to the small particle diameter side, and the triboelectrification amount also increased. As a result, the image density gradually decreased, and was 1.2 when 20,000 sheets were finished.

Comparative Example 2

The image forming apparatus shown in FIG. 1 was used, the image formation was performed on the following conditions, and the image density and toner flying/scattering on the transfer sheet were evaluated.

Conditions

The mixture (with a toner concentration of 4 wt %) of the grinding system nonmagnetic toner mainly containing the polyester resin, and the ferrite carrier with the surface subjected to the silicon coat treatment was used as the two-component developer. The following toner particle diameter, developing bias, and the like were used in each stage.

Weight average diameter (D1) of initial toner in developer container . . . 8.0 μm Weight average diameter (D2) of solid toner image on photosensitive member . . . 8.2 μm Weight average diameter (D3) of residual toner on photosensitive member . . . 7.3 μm Developing bias:

for DC . . . −500 V for AC . . . 2000 Vpp, 13 kHz, rectangular wave bright portion potential . . . −200 V Interval between development sleeve and photosensitive member . . . 500 μm Triboelectrification Amount The triboelectrification amount was measured under the environment of 23° C./50% R.H. by the above-described two-component blow-off process. As a result, the triboelectrification amount Q1 of the initial toner and the developing carrier was −25 mC/kg, the triboelectrification amount Q'of the residual toner on the photosensitive member and the developing carrier was −26 mC/kg, and the ratio of both was Q1/Q2=0.96.

In the image formation under the above-described conditions, when the image forming operation of 20,000 sheets was repeated, the volume average diameter of the toner particles in the developer container considerably shifted to the small particle diameter side, and the triboelectrification amount also increased slightly. As a result, the image density gradually decreased, and was 1.25 when 20,000 sheets were finished, and the flying/scattering indicated a slight increase tendency.

As described above, according to the present embodiment, even when the image forming operation is repeatedly performed over a long period, a satisfactory image can be formed without causing the image density decrease or the toner flying/scattering.

What is claimed is:

1. An image forming apparatus comprising:

an image bearing member for bearing a latent image;

a developing means for developing the latent image on said image bearing member to form a toner image by a developer containing a toner and a carrier; and a transfer means for transferring the toner image on a transfer material, the toner remaining on said image bearing member being collected into said developing means by said developing means after transfer by said transfer means;

wherein when a weight average diameter of the toner in said developing means is set to D1, and a weight average diameter of a toner forming the toner image on said image bearing member is D2, D1≧D2 is satisfied;

wherein said developing means includes a developer bearing member for bearing the developer, an alternating-current voltage is applied to said developer bearing member, and a frequency of the alternating-current voltage is not less than 6 kHz and not more than 12 kHz; and wherein the alternating-current voltage is intermittently applied.

2. The image forming apparatus according to claim 1, wherein, the frequency of the alternating-current voltage is not less than 8 kHz and not more than 10 kHz.

3. An image forming apparatus comprising:

an image bearing member for bearing a latent image;

developing means for developing the latent image on said image bearing member to form a toner image by a developer containing a toner and a carrier; and a transfer means for transferring the toner image on a transfer material, the toner remaining on said image bearing member being collected into said developing means by said developing means after transfer by said transfer means;

wherein when a weight average diameter of the toner in said developing means is set to D1, and a weight average diameter of a toner forming the toner image on said image bearing member is set to D2, D1≧D2 is satisfied;

wherein an average triboelectrification amount per unit weight of the toner in said developing means is Q1, and an average triboelectrification amount per unit weight of the toner remaining on said image bearing member is Q2, 0.8≦Q1/Q2≦1.5 is satisfied.

4. An image forming apparatus comprising:

an image bearing member for bearing a latent image;

a developing means for developing the latent image on said image bearing member to form a toner image by a developer containing a toner and a carrier; and transfer means for transferring the toner image on a transfer material, the toner remaining on said image bearing member being collected into said developing means by said developing means after transfer by said transfer means;

wherein when a weight average diameter of the toner in said developing means is set to D1, and a weight average diameter of a toner forming the toner image on said image bearing member is set to D2, D1≧D2 is satisfied;

wherein the toner contains colored resin particles, and an external additive of an inorganic particles with a smaller diameter than a diameter of the colored resin particles, and when an external addition ratio of the external additive decreases, an average triboelectrification amount per unit weight of the toner and the carrier increases.

5. An image forming apparatus comprising:

an image bearing member for bearing a latent image;

a developing means for developing the latent image on said image bearing member to form a toner image; and wherein toner remaining on said image bearing member is collected in said developing means;

wherein when a weight average diameter of the toner in said developing means is set to D1, and a weight average diameter of a toner forming the toner image on said image bearing member is set to D2, a developing electric field is formed between said image bearing member and said developing means so that D1≧D2 is satisfied.

6. The image forming apparatus according to claim 5, wherein said developing means includes, convey means for bearing and carrying the toner to said image bearing member, and the developing electric field is formed by applying a voltage in which a direct current voltage and an alternating current voltage are superposed on said convey means.

7. The image forming apparatus according to claim 6, wherein a frequency of the voltage in which the direct current voltage and the alternating current voltage are superposed is not less than 6 kHz and not more than 12 kHz.

8. The image forming apparatus according to claim 7, wherein the frequency of the voltage in which the direct current voltage and the alternating current voltage are superposed is not less than 8 kHz and not more than 10 kHz.

9. The image forming apparatus according to claim 6, wherein a developing electric field is formed by repeating alternately a first period for applying the voltage in which the direct current voltage and the alternating current voltage are superposed on said convey means and a second period for applying only the direct current voltage on said convey means.

10. The image forming apparatus according to claim 9, wherein a frequency of the voltage in which the direct current voltage and the alternating current voltage are superposed is not less than 6 kHz and not more than 12 kHz.

11. The image forming apparatus according to claim 10, wherein the frequency of the voltage in which the direct current voltage and the alternating current voltage are superposed is not less than 8 kHz and not more than 10 kHz.

12. The image forming apparatus according to claim 5, wherein an average triboelectrification amount per unit weight of the toner in said developing means is Q1, and an average triboelectrification amount per unit weight of the toner remaining on said image bearing member is Q2, $0.8 \leqq Q1/Q2 \leqq 1.5$ is satisfied.

13. The image forming apparatus according to claim 5, wherein the toner contains a colored resin particle, and an external additive of an inorganic particle with a smaller diameter than that of the colored resin particle, and when an external addition ratio of the external additive decreases, an average triboelectrification amount per unit weight of the toner and a carrier increases.

14. The image forming apparatus according to claim 5, wherein the toner is substantially spherical.

15. The image forming apparatus according to any one of claims 5 to 14, wherein said developing means develops by using a developer containing the toner and the carrier.

* * * * *

UNITED STATES PATENT AND TRADEMARK OFFICE

CERTIFICATE OF CORRECTION

PATENT NO. : 6,304,738 B1 
DATED : October 16, 2001
INVENTOR(S) : Yoshiaki Kobayashi et al.

It is certified that error appears in the above-identified patent and that said Letters Patent is hereby corrected as shown below:

Title page, Item [54] and Column 1, Line 2,
"DEVICE TONER" should read -- DEVICE --.

Drawings,
Sheet 3, "LIGHT EMITTING" should read -- LIGHT-EMITTING --.

Column 3,
Line 32, "alternating" should read -- alternating voltage --.

Column 5,
Line 66, "the" (second occurrence) should read -- an --.

Column 6,
Line 6, "the" (first occurrence) should read -- an --; and
Line 32, "than" should read -- relative to --.

Column 7,
Line 65, "et al." should read -- et al., --;

Column 8,
Line 45, "and" should be deleted.

Column 10,
Line 9, "lid 104." should read -- lid 104. ¶In this case, the entire weight of the measurement container 102 is measured, and represented by W1 (kg). Subsequently, in a suction unit 41 (its portion contacting the measurement container 42 is at least an insulating material), suction is performed via a suction port 47, and an airflow adjusting valve 46 is adjusted until a vacuum indicator 45 indicates a pressure of 250 mmAq ($250 \times 10^{-3} \times 9806.65 = 2.45 \times 20^{3}$ Pa). The suction is performed preferably for two minutes in this state to suck/remove the resin. In this case, the potential of an electrometer 49 is represented by V (volt). Here, numeral 48 denotes a capacitor, and the capacity is represented by C (F). Moreover, the entire weight of the measurement container 42 after the suction is measured, and represented by W2 (kg). The triboelectrification amount of the toner is calculated as follows: Resin triboelectrification amount (C/kg) = $(CxVx10^{-3})/(W1-W2)$ --.

UNITED STATES PATENT AND TRADEMARK OFFICE

CERTIFICATE OF CORRECTION

PATENT NO. : 6,304,738 B1
DATED : October 16, 2001
INVENTOR(S) : Yoshiaki Kobayashi et al.

It is certified that error appears in the above-identified patent and that said Letters Patent is hereby corrected as shown below:

Column 12,
Line 2, “with” should read -- without --;
Line 5, “manufactured” should read -- manufactured by --; and
Line 46, “with” should read -- without --.

Column 13,
Lines 21 and 64, “with” should read -- without --.
Line 28, “he” should read -- the --;

Column 14,
Line 19, “bright” should read -- ¶bright --; and
Line 40, “with” should read -- without --.

Column 15,
Line 49, “amount Q” should read -- amount Q2 --.

Column 16,
Line 25, “wherein,” should read -- wherein --;
Line 43, “wherein” should read -- wherein when --; and
Line 65, “particles” should read -- particle --.

Column 17,
Line 5, “image;” should read -- image; and --;
Line 7, “and” should be deleted;
Line 9, “means;” should read -- means; and --; and
Line 18, “includes,” should read -- includes --.

UNITED STATES PATENT AND TRADEMARK OFFICE

CERTIFICATE OF CORRECTION

PATENT NO. : 6,304,738 B1
DATED : October 16, 2001
INVENTOR(S) : Yoshiaki Kobayashi et al.

It is certified that error appears in the above-identified patent and that said Letters Patent is hereby corrected as shown below:

Column 18,
Line 15,"wherein" should read -- wherein when --.

Signed and Sealed this

Seventh Day of January, 2003

JAMES E. ROGAN
*Director of the United States Patent and Trademark Office*